United States Patent [19]

Novotny

[11] Patent Number: 4,813,848

[45] Date of Patent: Mar. 21, 1989

[54] TURBINE ROTOR DISK AND BLADE ASSEMBLY

[75] Inventor: Rudolph J. Novotny, Stuart, Fla.

[73] Assignee: United Technologies Corporation, Hartford, Conn.

[21] Appl. No.: 108,390

[22] Filed: Oct. 14, 1987

[51] Int. Cl.[4] ..... F01D 5/18

[52] U.S. Cl. ..... 416/95; 416/213 R; 416/244 A

[58] Field of Search ..... 416/95, 96 R, 213 R, 416/244 A

[56] References Cited

U.S. PATENT DOCUMENTS

| | | | |
|---|---|---|---|
| 2,380,276 | 7/1945 | Warren | 416/244 A |
| 3,588,276 | 6/1971 | Jubb | 416/95 |
| 3,658,439 | 4/1972 | Kydd | 416/97 R |
| 3,730,644 | 5/1973 | Jubb | 416/244 A X |
| 3,749,514 | 7/1973 | Kelch et al. | 416/95 |
| 3,847,506 | 11/1974 | Straniti | 416/244 A |
| 4,047,837 | 9/1977 | Hueber et al. | 416/95 |
| 4,062,638 | 12/1977 | Hall | 416/213 R |
| 4,152,816 | 5/1979 | Ewing et al. | 416/213 R X |
| 4,156,051 | 5/1979 | Nakamura | 416/213 R X |
| 4,312,625 | 1/1982 | Pinaire | 416/96 R |
| 4,668,167 | 5/1987 | LeMaoût | 416/220 R |

*Primary Examiner*—Everette A. Powell, Jr.

*Attorney, Agent, or Firm*—Edward L. Kochey, Jr.

[57] ABSTRACT

A turbine rotor with air cooled blades has a turbine disk and a continuous hoop circumferential turbine rim bonded thereto. The rim has a plurality of circumferential rings extending toward the disk and forming circumferential chambers therebetween.

Near the outer edge of the turbine rim are transversely extending openings. The rim is wire cut from these openings from the outer periphery forming segmented blade platforms, allowing the thermal expansion of the platform to occur. Tubes within the openings convey cooling air to the circumferential chambers, from which it passes to the blade interiors and through cooling openings in the platforms.

6 Claims, 2 Drawing Sheets

TURBINE ROTOR DISK AND BLADE ASSEMBLY

TECHNICAL FIELD

The invention relates to gas turbine rotors and in particular to high temperature rotors having air cooled blades.

BACKGROUND OF THE INVENTION

Bladed turbine disks rotate at high speed in an extremely hot environment. Full hoop material is required to resist the centrifugal forces. Any material not contributing to the hoop is dead load, adding weight but not contributing to strength.

A bonded circumferential multi-ring disk is disclosed in copending Application Serial No. (108,171 filed 10-14-87). That arrangement uses multiple circumferential rings near the outer rim of the disk connecting the disk to the blade platform ring. The arrangement provides high strength with low weight, but does not provide for high temperature considerations.

High temperature blading also requires air cooling through the blades with the air passing out openings in the blades into the gas stream. An internal flow path is required to direct the cooling air into the blades.

Rotor assemblies operating in high temperature environments also experience extremely high temperatures in the outer periphery of the rotor assembly. This high temperature causes expansion introducing thermal stress in the disk unless some provision is made to absorb the expansion.

SUMMARY OF THE INVENTION

A turbine rotor disk and blade assembly includes a turbine disk of high strength material and has a circumferential disk platform at its outer periphery. A continuous hoop circumferential turbine rim of high temperature material is bonded to the disk platform.

The turbine rim is comprised of a plurality of continuous circumferential rings supporting a segmented ring of blade platforms, each of which carries a turbine blade. A transverse opening near the outer edge of the rim carries a tube conveying cooling air under the blade platforms and to the blade interior. Cuts forming the segments of the blade platforms extend to the transverse opening.

Cooling air is thereby introduced at the outermost radial location and is accordingly not heated in going to a larger radius inside the disk. The cooling air therefore is at a lower temperature as it reaches the blades. A lightweight rotor assembly is formed with substantial hoop material, being broken only at the high temperature periphery where provision for thermal expansion is required. Strength of the rotor assembly is further improved by forming the openings as elliptical holes having the major axis in the circumferential direction, thereby decreasing stress concentrations.

DESCRIPTION OF THE PREFERRED EMBODIMENT

Figure 1:
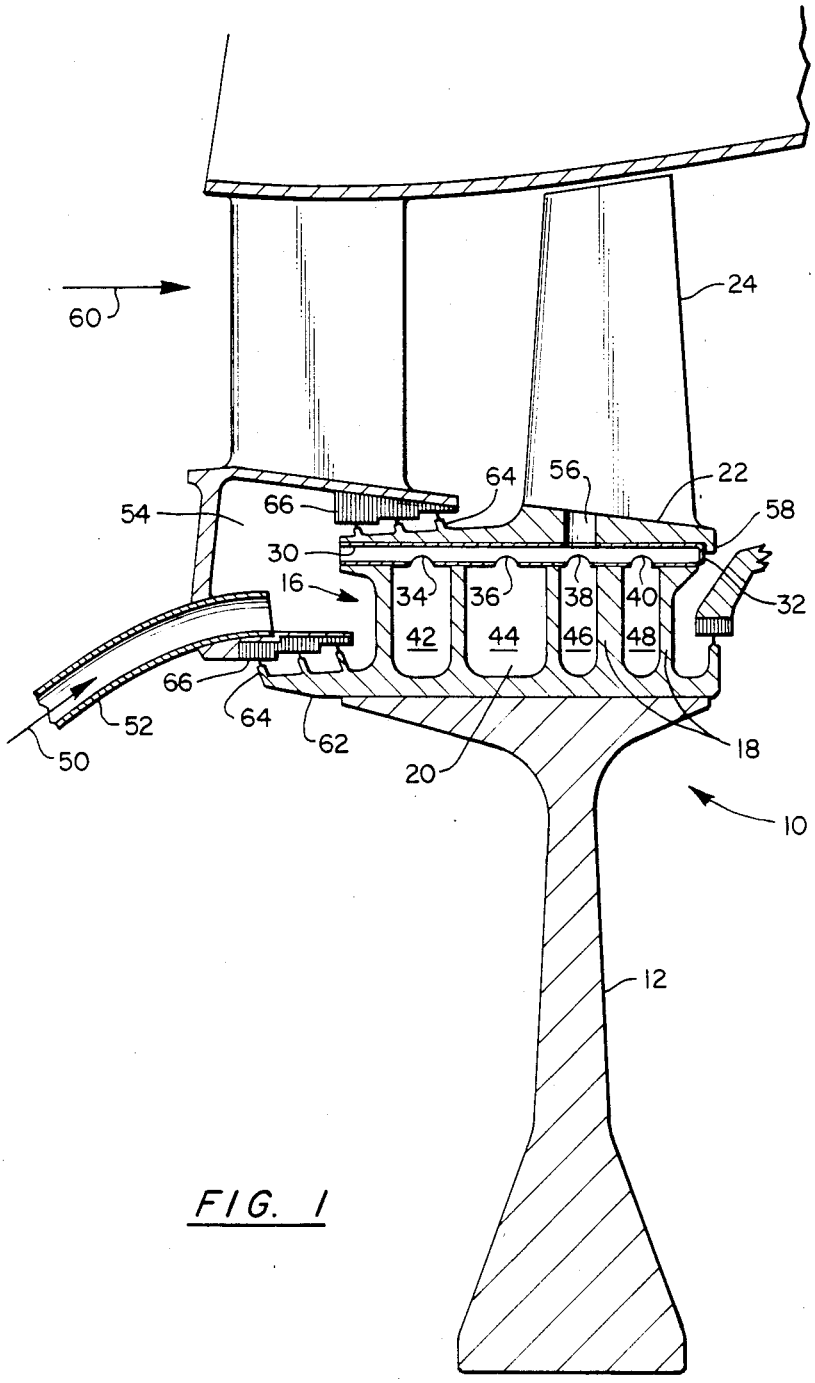
FIG. 1 is a sectional view through half the rotor assembly.

A gas turbine rotor disk and blade assembly 10 is formed of a turbine disk 12 which has a disk platform 14 at its outer periphery. The continuous hoop circumferential turbine rim 16 is bonded to the disk platform 14. The turbine disk 12 may be of a lightweight, high strength material whereas the turbine rim 16 is preferably of a high temperature resistant material.

The turbine rim 16 is cast with a plurality of rings 18 forming a plurality of internal chambers 20 around the circumference of the rim. The use of nickel as a material for this rim facilitates the casting since it does not leave a brittle scale as would be left by titanium, and therefore does not require internal clean up of the casting.

Figure 2:
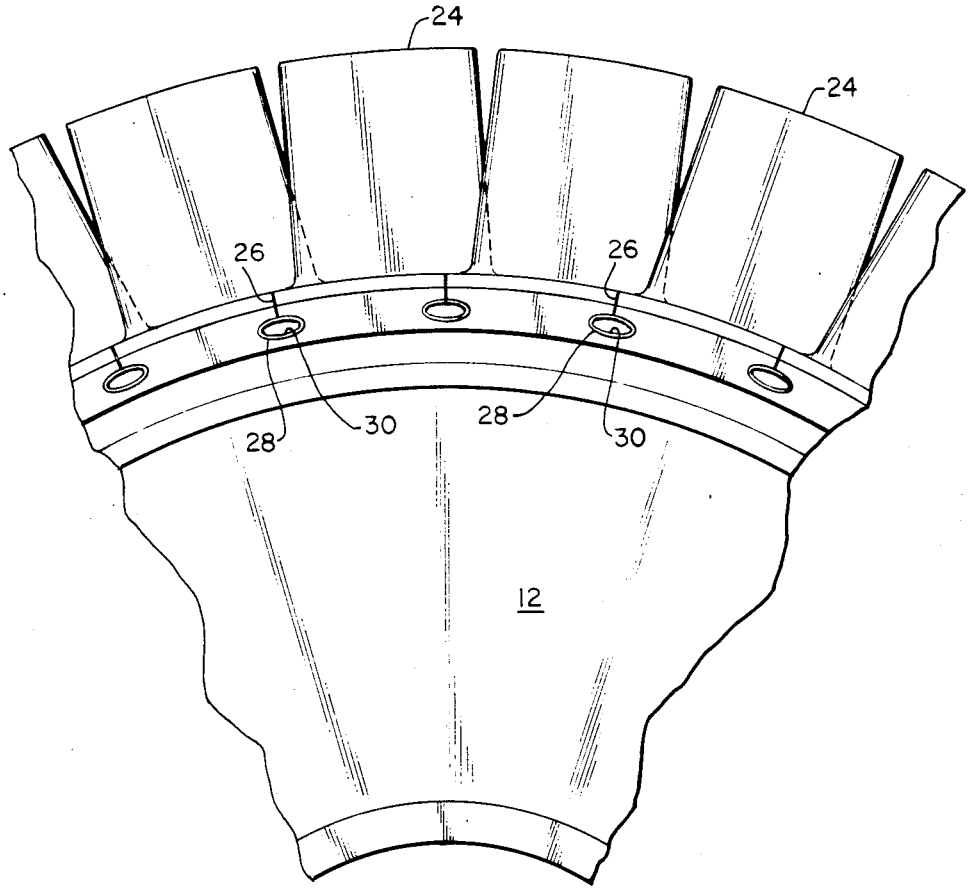
FIG. 2 is a partial side elevation showing the cooling air inlet openings.

Around the circumference there are a plurality of blade platforms 22 each carrying a blade 24, the segments being formed by cuts 26 as seen in FIG. 2.

Transverse openings 28 pass through the turbine rim, preferably not being parallel to the axis but being skewed to pass between the turbine blades. The cuts 26 pass from the outer periphery to the openings 28. Within each opening there is placed a sheet metal tube 30 which is closed at its downstream end 32. This tube has openings 34, 36, 38 and 40 in fluid communication with chambers 42, 44, 46 and 48, respectively. Cooling air 50 is supplied through inlet tube 52 into plenum 54. From here it passes into tube 30 with a majority of the air passing into plenum 46 and through opening 56 into the interior of the blades 24. The cooling air after passing through the flow path inside the blade exists through openings (not shown) in the blade.

A further portion of the cooling passing into tube 30 enters chambers 42, 44 and 48 passing thereafter through small openings (not shown) in the blade platform 22 for the purpose of cooling the blade platform.

The blade platform 22 has a radially inwardly extending small member 58 with the shoulder facing toward the tube 30. This is located at the end of the openings 28 so that the closed end tube 30 is restrained from axial movement by this shoulder.

At the upstream side with respect to gas flow 60 of the turbine rim is an extending cantilever arm 62 carrying a plurality of knife edge seals 64. These seals interact with seal surface 66 for the purpose of retaining air within plenum 54. The wire cut slot 26 which is on the order of 0.002 inches wide also passes through these knife edge seals, with the air leakage still being limited to a tolerable amount.

The structure described combines the rim nonhoop requirement for relief of thermal stresses with the cooling air inlet requirement while allowing one disk to support both the blade and the air inlet components, reducing both the weight and quantity of parts. A smaller lightweight turbine rotor disk and blade assembly is achieved. The integral air inlet provides a 50 to 70 degree Fahrenheit lower cooling air temperature to the blades offering a improved blade life and/or a reduced quantity of cooling airflow.

Frictional movement between the blade platform and the tube provides damping of the blades. Since the tube seals the opening between blade platforms it eliminates the need for feather seals. With the tube end sealing the end of the air flow opening, the disk being impervious inward of the opening, and only a nominal slot outward of the opening, no cover plates are required.

The openings in the tube may be sized to meter various flows to the corresponding plenums in proportion to the cooling requirements. These openings may be easily modified to allow trimming of cooling air flow in cooling development.

I claim:

1. A turbine rotor disk and air cooled blade assembly comprising:

a turbine disk;

a disk platform at the outer periphery of said disk;

a continuous hoop circumferential turbine rim bonded to said disk platform;

said turbine rim having an inner continuous circumferential rim bonded to said disk platform, a plurality of continuous circumferential inwardly extending rings integral with said inner rim, a segmented circumferential blade platform integral with said rings, a turbine blade integral with each segment of said blade platform, and transversely extending openings through said rim associated with each blade near the outer surface of said blade platform in fluid communication with the interior of the corresponding blade.

2. An apparatus as in claim 1:

said blade platform segmented by a transversely extending cut from the outer surface of said platform to each transversely extending opening.

3. An apparatus as in claim 1:

a tube having a downstream end closed inserted into each opening; and said platform having an inwardly radially extending shoulder abutting the downstream end of each tube.

4. An apparatus as in claim 1:

said turbine rim having a cantilevered axially extending ring extending upstream with respect to turbine gas flow and carrying on its outer periphery a plurality of knife edge seals.

5. An apparatus as in claim 1:

said opening elliptical in cross section with the major axis circumferentially oriented.

6. An apparatus as in claim 1:

said rings forming internal chambers between the rings, the inner rim and the blade platform; and a plurality of cooling holes through said platform in fluid communication with each chamber, said opening also in fluid communication with said chambers.

* * * * *